US006345993B1

(12) United States Patent
Lalaouna et al.

(10) Patent No.: US 6,345,993 B1
(45) Date of Patent: Feb. 12, 2002

(54) COMPACT BRANCH CONNECTOR FOR AT LEAST ONE BRANCH NEUTRAL CABLE INTO A MAIN NEUTRAL CABLE AND SIMULTANEOUS GROUNDING

(75) Inventors: Said Lalaouna, Barcelone (ES); Jean-Luc Couvert, Bevenais; Marion Biasotto, Le Vaudreuil, both of (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/585,046

(22) Filed: Jun. 1, 2000

(30) Foreign Application Priority Data

Jun. 3, 1999 (FR) ..... 99 07163

(51) Int. Cl.[7] ..... H01R 4/66
(52) U.S. Cl. ..... 439/92
(58) Field of Search ..... 439/402, 92, 98, 439/100, 781

(56) References Cited

U.S. PATENT DOCUMENTS 4,257,658 A * 3/1981 Hammond et al. ..... 339/14

FOREIGN PATENT DOCUMENTS

| | | |
|---|---|---|
| FR | 2 524 210 | 9/1983 |
| FR | 2645683 A1 | 10/1990 |
| FR | 2744289 A1 | 8/1997 |

* cited by examiner

*Primary Examiner*—Tho D. Ta
*Assistant Examiner*—Phuong Chi Nguyen
(74) *Attorney, Agent, or Firm*—Perman & Green, LLP

(57) ABSTRACT

The invention addresses an electric connector for the assembly of at least one branch neutral cable (24) into a main neutral cable (26) of the type including a lower body (10) and an upper body (12) both having contact blades, members (20, 22) for accommodating these cables between the two bodies, as well as clamping feature (28), characterized in that it comprises grounding feature (112) in contact with at least one of the blades.

7 Claims, 8 Drawing Sheets

COMPACT BRANCH CONNECTOR FOR AT LEAST ONE BRANCH NEUTRAL CABLE INTO A MAIN NEUTRAL CABLE AND SIMULTANEOUS GROUNDING

BACKGROUND OF THE INVENTION

1. Field of the Invention

Compact branch connector for at least one branch neutral cable into a main neutral cable and simultaneous grounding.

The present invention relates to a compact branch connector allowing to connect at least one branch cable into one neutral cable with simultaneous grounding.

2. Description of the Prior Art

Branch connectors are known which allow to make connections of one branch cable on a main or neutral line, by perforation of the insulating material.

These connections are independent for each phase, i.e. three connections are required for three-phased current, whereto the branch connection for the neutral cable and the ground connection are to be added.

The problem consists in providing compact branch connectors while reducing the size of these connectors and to allow grounding of the branch neutral connector in order to limit the number of components.

One of the restrictions imposed by specifications is to provide a secure connection, which means that the operator shall be certain, during the installation, that the connector is properly mounted. Therefore, the cables must be positioned with the highest precision and clamping operations must be assisted by torque meters, whereby satisfactory electric contacts can be ensured.

From patent application FR-A-2 744 289, a branch connector for an underground cable is known, which comprises two parts, an upper part and a lower part, fastened together by a central screw having means for controlling the clamping torque mutually exerted by the upper and lower parts.

In a plane perpendicular to the clamping direction, these two bodies have, on one side, a housing designed to accommodate the end/s of one or two branch cables and, on the other side, a housing formed by two half-grooves of the upper and lower parts respectively. Plugs ensure the seal of these housings when they are not used.

Two transverse conductive blades, also borne by the upper and lower parts respectively, perforate and cut at the same time the insulating sleeves of the main cable and of the branch cable to contact their conductive cores.

SUMMARY OF THE INVENTION

This invention proposes a connector for at least one branch neutral cable into a main neutral cable by simultaneously-acting grounding means, which has a high compactness, which allows to connect one or two branch neutral cables into a main neutral cable, which allows to orient the connector with respect to the cable and especially with respect to the other conductors, which includes installation aids, which is reliable and includes integrally molded parts for an optimized industrial production.

This invention relates to an electric connector for the assembly of at least one branch neutral cable into a main neutral cable of the type comprising a lower body and an upper body both having contact blades, means for accommodating these cables between the two bodies, as well as clamping means, and being characterized in that it comprises grounding means in contact with at least one of the blades.

These grounding means, according to a first variant, comprise a screw whose shank, oriented along the Z-axis, has a slot and a threaded end, designed to allow the passage through a hole formed in the lower body and to accommodate the end of a braid, as well as a nut.

In accordance with a second variant, the grounding means comprise a screw, oriented perpendicular to the Z-axis, whose head has a transverse slot, said screw having a threaded end and a nut to accommodate the end of a braid.

The braid, in these two cases, comprises a crimped terminal, with an eye for the passage of the screw shank.

According to a further variant, the grounding means comprise at least one hole formed in the lower body and opening on the external side of at least one of the blades, said hole being provided to accommodate the end of the braid.

In this case, the braid comprises a terminal with an eye fitting the hole profile.

BRIEF DESCRIPTION OF THE DRAWING

The present invention will be further described in further detail according to a particular embodiment and variants thereof, with reference to the accompanying drawings, whose different figures show.

DETAILED DESCRIPTION OF THE PREFERRED EMBODIMENTS

Figure 1A:
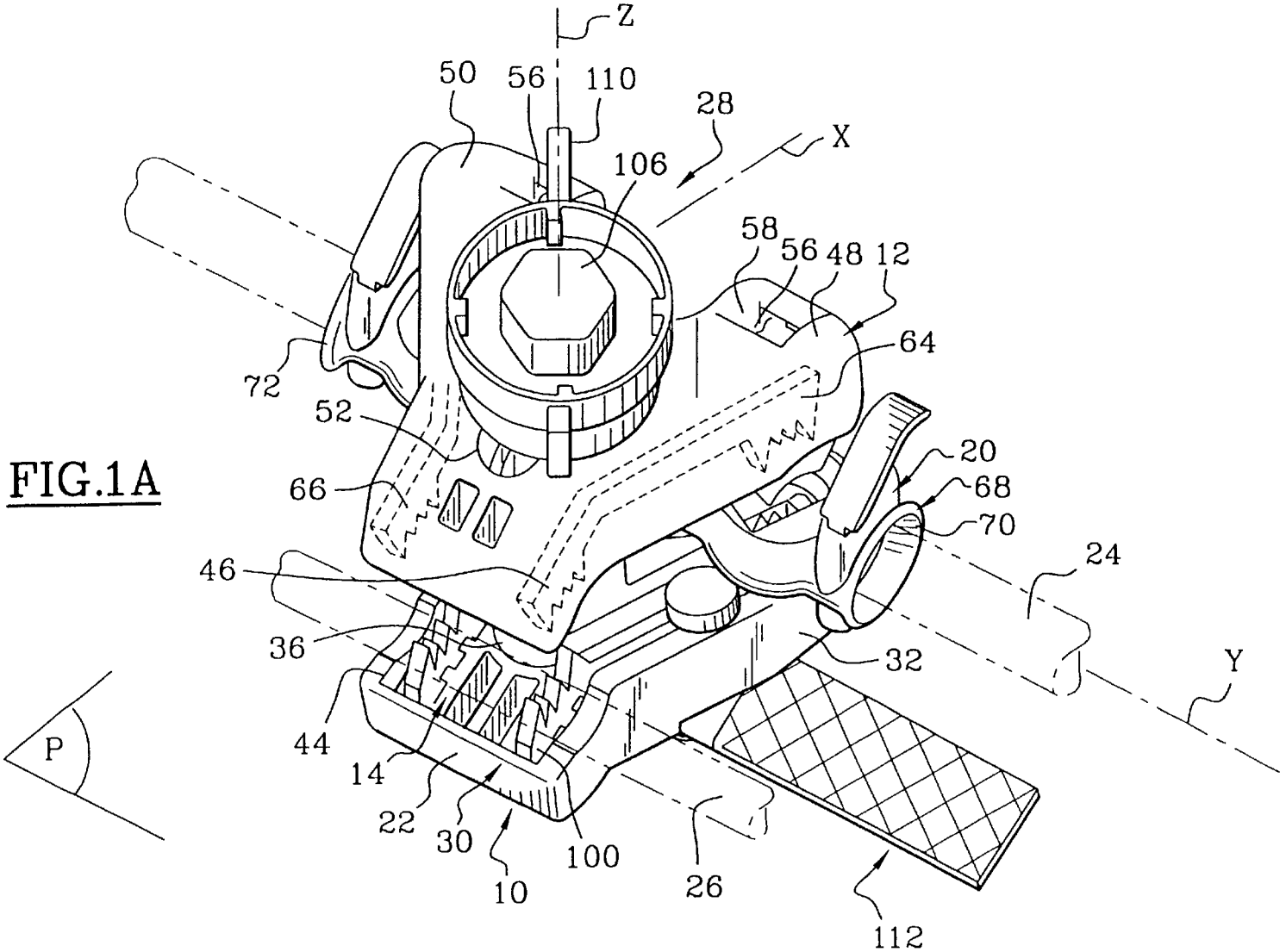
FIG. 1A, a perspective view of a neutral connector, mounted onto a main neutral cable, comprising a first embodiment of the grounding means, FIG. 1B, a bottom perspective view of a connector like the one shown in FIG. 1A, FIG. 1C, a perspective exploded bottom view of the lower part of the same connector as shown in FIGS. 1A and 1B, before assembly, FIG. 2A, a perspective top view of a second embodiment of the grounding means, FIG. 2B, a perspective exploded view of the lower part of this second embodiment, FIG. 3A, a perspective view of the lower part only of a third embodiment of the grounding means, FIG. 3B, a perspective view of the third embodiment of the grounding means, through a different angle from the one of FIG. 3A, FIG. 3C, a perspective exploded view of the lower part of the embodiment as shown in FIG. 3B.

The invention will be now described in further detail with reference to the different figures, as regards the connector.

The connector comprises a lower body 10 and an upper body 12 made of an insulating material and designed to be clamped against each other, a lower insulating cleat 14 and an upper insulating cleat 16, each accommodating electric connection blades 18, means 20 and 22 for accommodating at least one branch cable 26 and one single main cable 26 respectively, as shown in a very simplified manner in dashed lines, as well as directional clamping means.

As shown in FIG. 1A, the lower body 10 has an Y-shaped bottom side, having a first half-base 30 and two stems 32, 34. A threaded housing 36 is provided substantially at the geometric center of this body.

This housing 36 protrudes and is oriented perpendicular to the plane of the body, i.e. perpendicular to the longitudinal axis of the cables, this direction being thereafter referred to as Z.

At the ends of each stem 32 and 34, guide pins 38 are formed of one piece with the lower body. These pins comprise elastic retaining hooks 42.

The lower body 10 comprises a housing 44, also Y-shaped, substantially centered with respect to the whole body, the housing being provided to accommodate the lower insulating cleat 14, having a mating profile.

Figure 1B:
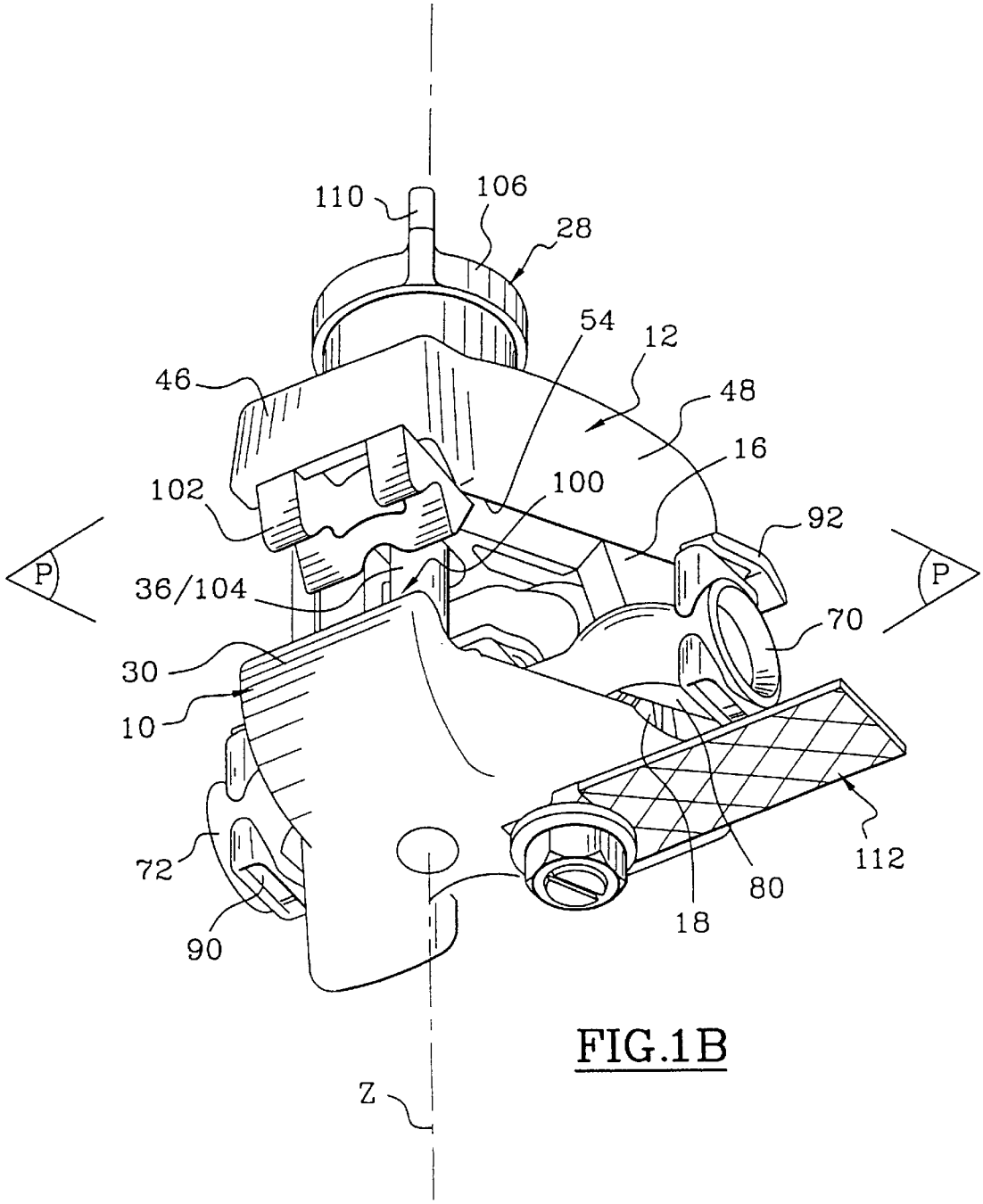

As shown in FIG. 1B, the upper body 12 also has a Y-shaped bottom side, with a second half-base 46, symmetric to the first base 30 with respect to the median contact plane P, which is perpendicular to the clamping axis Z. This body also comprises two stems 48, 50, symmetric to the stems 32 and 34 with respect to said plane P. A hole 52, having an elongated shape, whose longer axis is superposed on the axis X passing between the stems of the Y shape, is provided substantially at the geometric center of this upper body 12.

In FIG. 1B, the numeral 54 denotes a Y-shaped housing, equivalent to the housing 44 of the lower body, provided to accommodate the matching upper insulating cleat 16.

In FIG. 1A, two through holes 56 are shown, parallel to the clamping axis Z, and disposed in such a manner as to face the guide pins 38 borne by the lower body 10 and to allow the passage thereof.

In each of these holes, calibrated rupture abutments 58 protrude inwardly. These abutments keep the two bodies spaced apart when no clamping effort is exerted thereon.

FIG. 1A shows more clearly the asymmetric dome shape of the bottom of the upper body 12 in the transverse direction.

Two pairs of independent electric connection blades 60, 62; 64, 66 are provided, which are made of a conductive material having a sufficient stiffness to ensure that the insulating materials are perforated. Each blade is placed in the housing of the corresponding stem of the cleat wherein it is inserted or molded, the material preferably being a flexible polymer.

Also, in each of the lower and upper bodies, there are provided two blades whose ends at the branch neutral cable side are spaced apart and the ends at the main cable side are close together.

This is a particularly interesting advantage, allowing to accommodate several connectors of this type, each on the cable of one of the phases of the main harness, which provides, over a short length, an assembly of the required compactness. Further, the Y shape allows to increase the safe distance between the end of the branch connector and the perforation point.

In a suitable manner, the ends of the contact blades have increasingly deep teeth, which form a curve fitting the diameter of the cables or which have the same height but are oriented radially, the average diameter of the cables to be laid being also considered, so that a good penetration may be achieved.

The means 20, 22 for accommodating at least one ranch cable 24 and one main cable 26 comprise, regarding the former, a housing cylindrical tube 68. This tube has two entries 70, 72 at its ends, each having a lead-in cone.

The tube comprises means 74 for fastening it to the lower body 10. More exactly, in the preferred mode, these fastening means are split rings 76 designed for sliding on the guide pins 38 and mounted, perpendicularly, along a generator of the tube, for the latter to be perpendicular to the clamping axis Z when it is in its proper position.

Figure 3A:
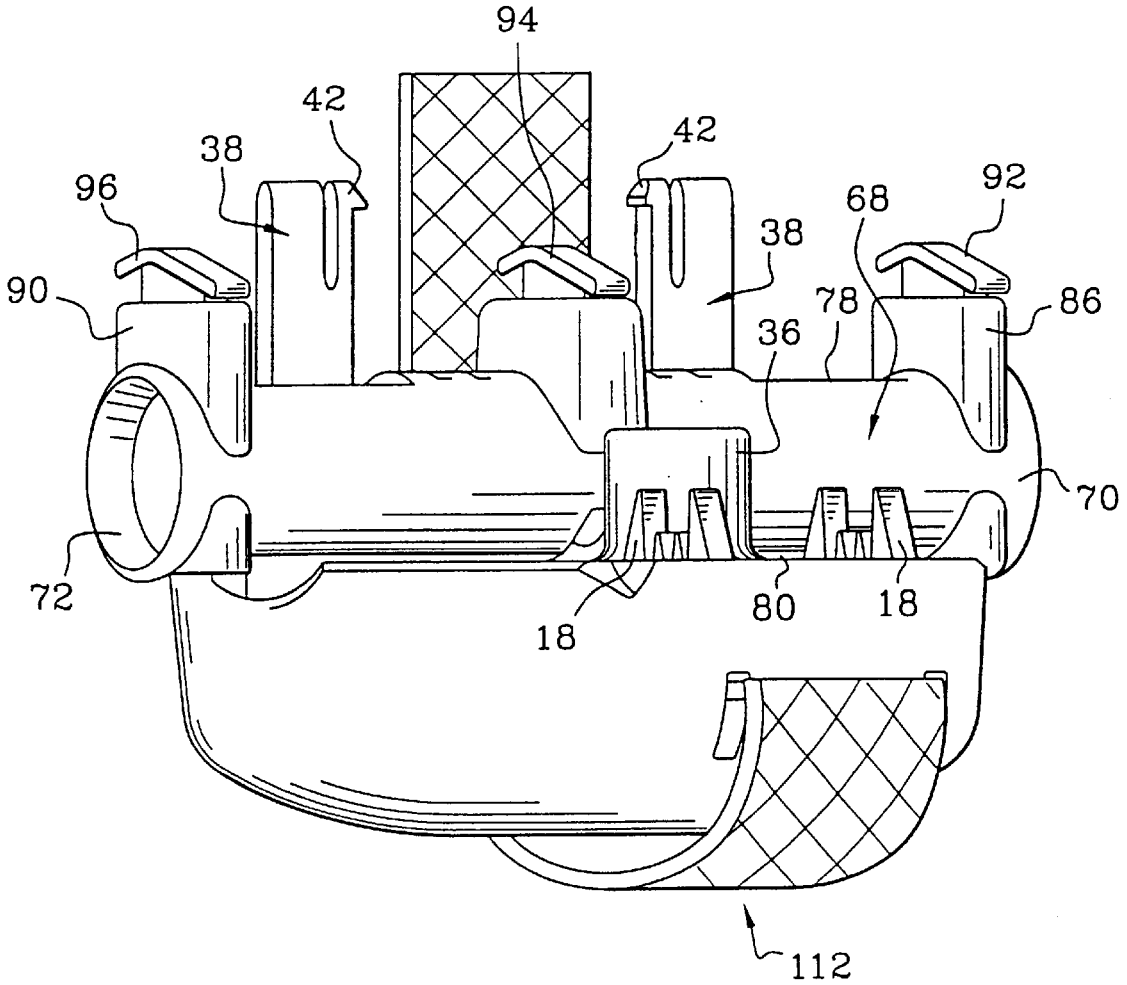
Figure 3B:
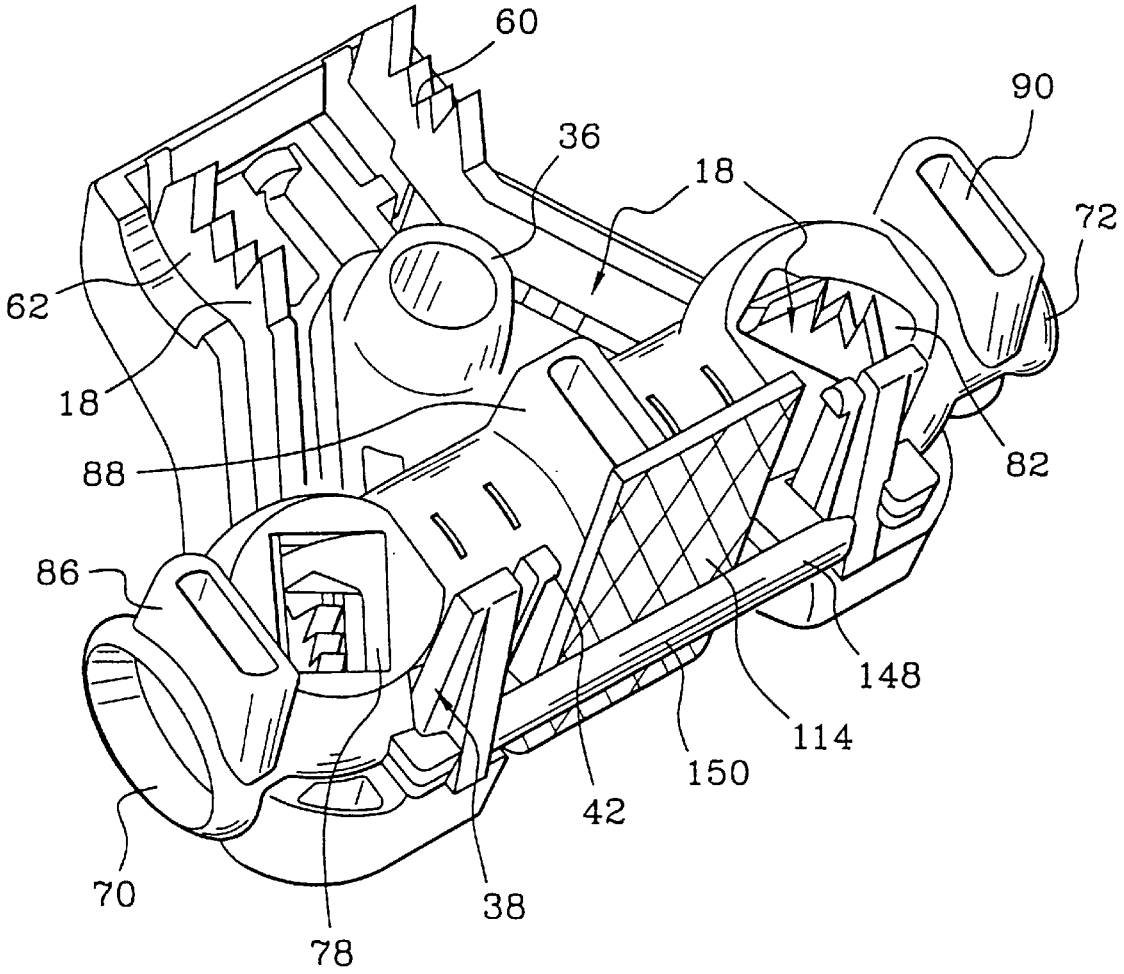

The tube, illustrated in detail in FIG. 3B particularly shows two pairs of apertures 78, 80; 82, 84, respectively in the proximity of the first and second entries 70 and 72.

These apertures are so oriented as to be inclined with respect to the longitudinal axis of the branch cables and of the cables more generally, to allow the passage of the ends of the cleats of each contact blade protruding therefrom. It is for this reason that the apertures are much larger than the ends of the contact blades. So, the ends of the cleats ensure continuity of insulation with the tube, at the front side of the apertures.

The tube also has slots, three in number, 86, 88, 90, whereof one 88 is disposed at the center and the other two 86, 90 substantially juxtapose the cone of each of the entries 70, 72. These slots are open and oriented transverse to the tube. Protruding guiding walls are provided in the upper part.

These slots are designed to accommodate flap shutters 92, 94, 96.

These passing shutters have elastic fingers ensuring the lock thereof in the inserted position.

The median shutter 94 divides the tube 68, into two inner half-tubes. The other two shutters 92, 96 ensure that the entries 70, 72 are shut when they are not used.

The means 22 for accommodating the main cable simply comprise two semi-cylindrical seats 100, 102 arranged at the lower and upper bodies as well as in the cleats 14 and 16.

Two pairs of contact blades are shown, consisting of an upper and a lower blade, which are positioned on both sides of the main cable.

The different blades have a small gap therebetween, which does not affect the electric efficacy due to their being on the same cable, and provides an important advantage in view of compactness.

In the retained embodiment, the directional clamping means 28 comprise a screw 104 whose threaded shank passes through an elongated hole 52 formed in the upper body 12 and cooperates with the threaded housing 36 of the lower body 10 by being screwed therein.

A calibrated rupture clamping device such as a screw cap 106 is molded on the screw head 104, said cap having adjusting ears 110. The adjusting ears 110 are connected to the cap by first calibrated rupture rotary connection means and the screw cap 106 is provided with second calibrated rupture rotary connection means for connection to the screw head 104.

The installation of the connector will be now described in detail.

The operator shall first separate the-cables of the different phases from the main harness, so that a connector according to the present invention may be mounted thereon, and more particularly the main neutral cable. As is apparent, the insulating material which envelopes the harness shall only be retracted over a short length, thanks to the small size of the connectors being used. No cable must be peeled off.

In the case of a single branch neutral cable to be connected, the latter is inserted in the tube 68 through the entry 70 after removing the first shutter 92 and the median shutter 94. Then, the cable is inserted all over the length of the tube until it abuts against the last shutter 96. According to a useful improvement, the tube is made from a transparent material to allow the operator to have a visual control thereon.

So, the branch neutral cable may be safely held by the operator.

The upper body is kept at a distance from the lower body by calibrated rupture abutments 58 which prevent the guide pins from sliding inside the holes 56. It is also apparent that the upper body cannot be separated from the lower body since the elastic hooks 42 ensure retainment thereof.

In this manner, the blades 18 in their insulating cleats 14 and 16 are spaced apart and allow the branch neutral cable to penetrate the tube.

Similarly, the operator can pinch the corresponding neutral cable of the main harness like a jaw, the cable being positioned in the two semi-cylindrical seats 100, 102 disposed at the lower and upper bodies as well as in the cleats 14 and 16.

To this end, the operator controls the ears 110 of the screw cap 106 and causes this cap to rotate and to drag along the screw head 104 which cooperates with the thread of the housing 36 of the lower body. This action drives the two bodies closer and allows the connector to be pinched on the main conductor. Clamping is performed manually until the first calibrated rupture rotary connection means between the ears and the clamping cap are torn off, with no potential difference being created.

Further, the clamping operation is continued by means of a wrench driving the hexagonal head of the screw cap 106. This clamping action causes the controlled rupture temporary stop elements 58 to be broken. At the same time, as the two bodies are driven closer to each other, the blades 18 penetrate by their teeth the conducting core of the main and branch cables after passing through the cleats and the insulating materials of-the main and branch cables.

When the second calibrated rupture means interposed between the screw head and the screw cap are torn off, the clamping torque has reached a sufficient value to ensure the durability of electric contacts, while preventing any overclamping.

Hence, as the two bodies are driven closer to each other, the contact blades 18 penetrate by their teeth the conducting core of the main cable and of the branch cable after passing through the insulating material.

The cleat abut on the insulating material of the cables, thereby ensuring continuity of insulation and preventing any access to a conducting part of the blades, from the beginning of the clamping action and during it.

The contact surface is improved for the branch neutral cable, because the lower and upper contact blades are inclined with respect to the cable axis. In this embodiment the electric contact is particularly good in quality, because the two pairs of blades penetrate the same branch cable.

It can also be noted that this connector has a wider application range, related to the diameters of the main wire whereto it can be connected.

In fact, when a sufficiently important diameter difference exists between the main cable and the branch cable, during the clamping action the upper body swings thanks to the elongated hole with respect to the screw 104 and directs itself to ensure a suitable clamping stress, distributed to all the cables.

The connectors are shown to have a trapezoid shape, allowing the operator to mount a first connector on a first cable of the main harness, and a second connector on a second cable of the harness, the two connectors being positioned substantially head to foot, which allows a considerable space gain. Then, particularly on a harness with a neutral cable as described in the present invention, the compact assembly of the connectors according to the invention is interesting.

Where the operator needs to connect two branch cables into a single cable of a main harness, the procedure to be followed, in the main steps, is the same as the one described above, with a few variants. First, the median flap shutter 94 is kept in its position, while the shutters 92 and 96 are removed. Then, the first branch neutral cable is inserted through the first entry 70 until it abuts against the median shutter 94 and the second branch wire is also inserted in the tube through the entry 72 until it also abuts against the median shutter 94.

In this manner, the cables are surely well positioned with respect to the contact blades. Without this arrangement, one of the cables might be perforated by one of the pairs of blades and partially by the other while the other cable might slip out or be poorly penetrated by the blades, which would not provide a reliable connection.

Then the operator starts the clamping action after pinching the main cable.

The above advantages are also found in this variant.

After this description of the connector, a definition would be useful of the simultaneous grounding means according to the different variants, to be combined with said connector.

Figure 1C:
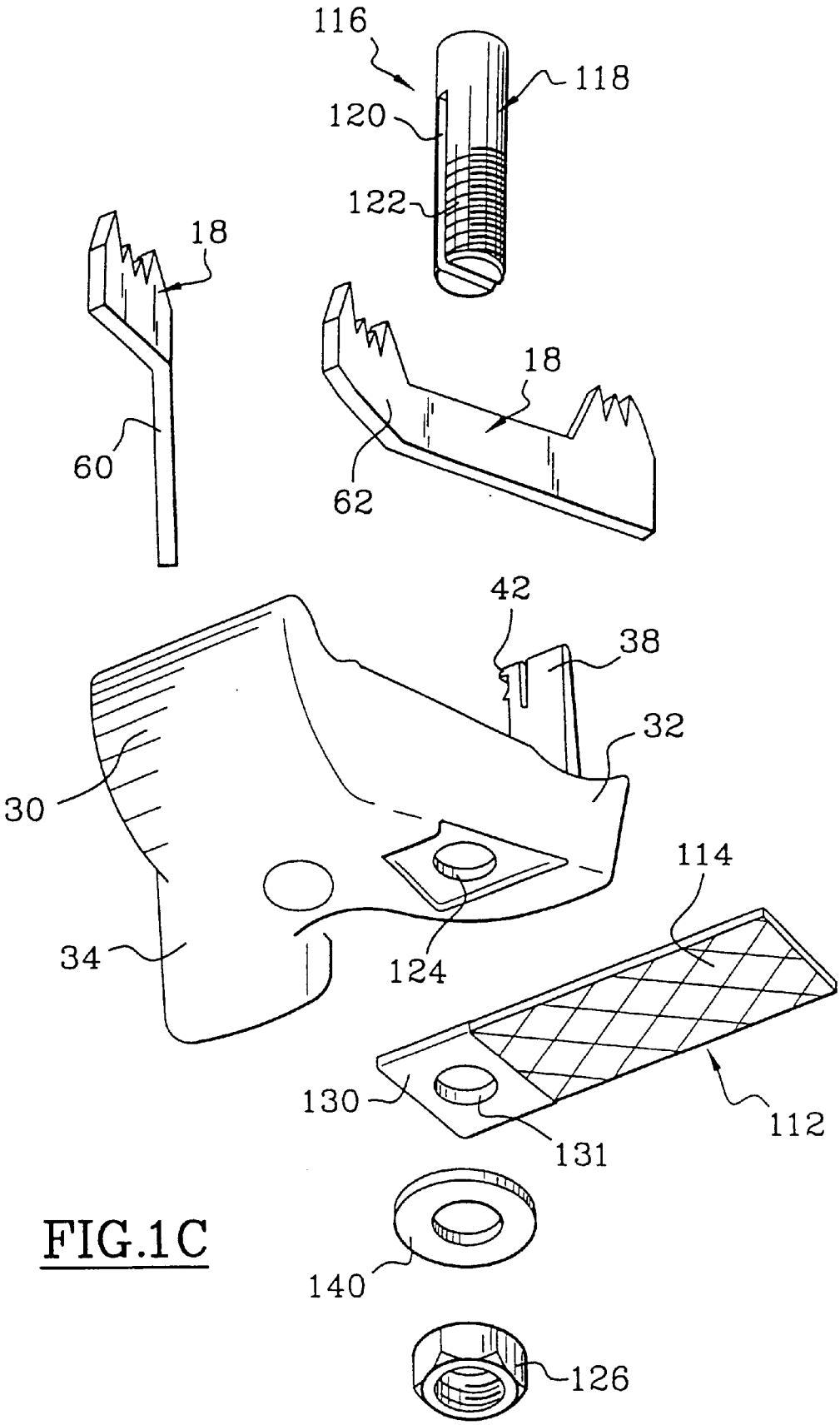

FIGS. 1A, 1B and 1C show the first embodiment of the grounding means 112.

These means comprise a grounding braid 114, one of whose ends should be electrically connected to at least one of the blades 18. To this end the grounding means 112 comprise a headless screw 116, whose shank 118 has a slot 120 over a part of its height from its threaded end 122. The slot has a width adjusted with respect to the thickness of the blade 18.

The lower body has a through hole 124, centered on one of the blades 18 and oriented parallel to the Z axis.

Therefore, upon installation, the screw 116 need only be placed astride the corresponding blade 18, borne by the lower body, thanks to the slot 120.

The assembly is performed before placing the upper body on the lower body, during the preassembly. It is apparent that, since then, the screw 116 cannot slip out.

There is also provided a washer 128 and a nut 126 screwed onto the threaded end 122 of the screw 116.

The end of the braid is provided, in a well-known manner, with a crimped terminal 130, with an eye 131 in it, the diameter of this eye being adapted to the diameter of the screw 116.

The terminal 130 need only be interposed between the lower body and the washer 128, while tightening the nut 126 as shown in FIG 1B. Advantageously, the lower body comprises a flat part, for instance molded of one piece with said body, allowing a proper support of the crimped terminal 130.

Figure 2A:
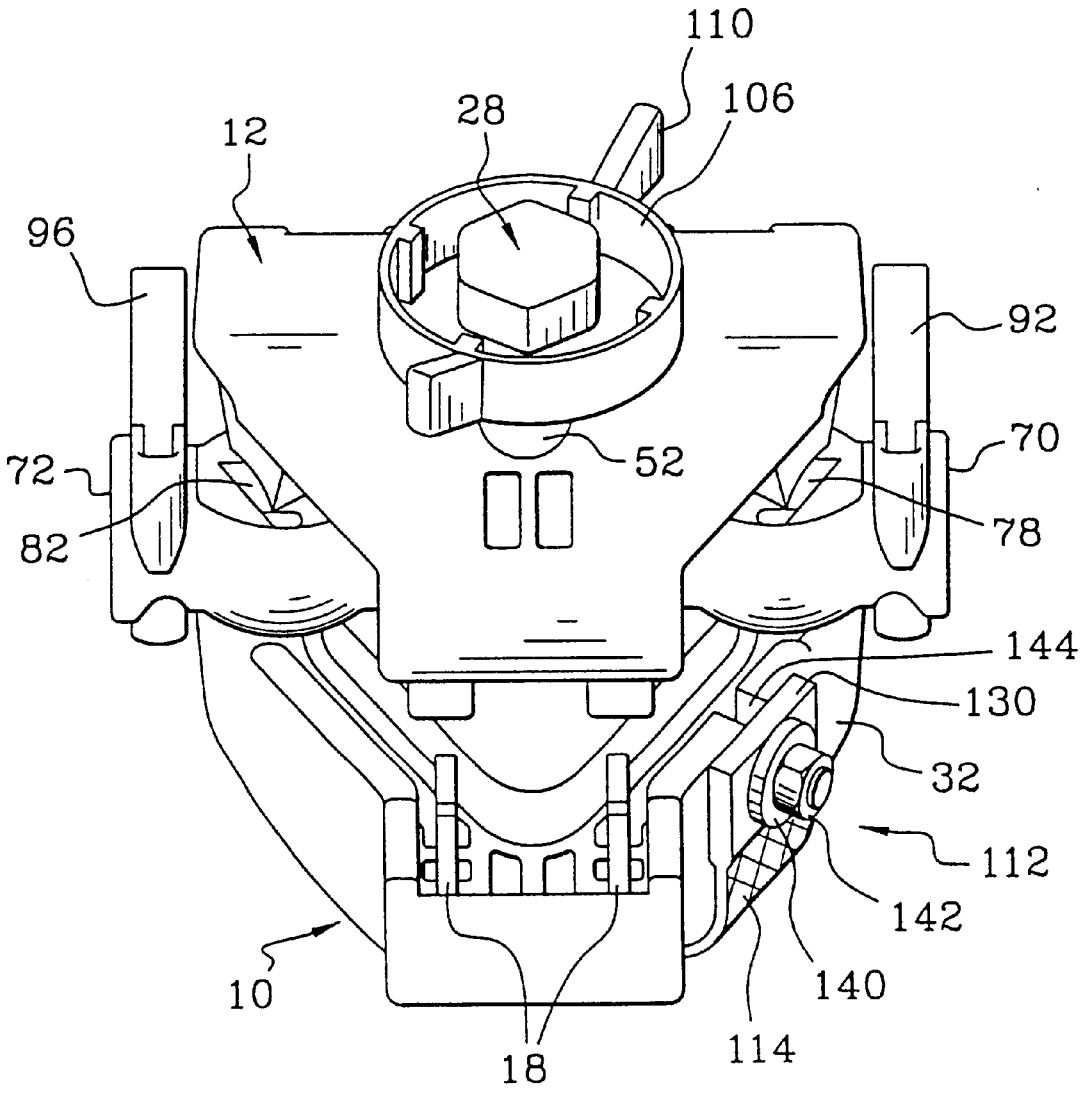
Figure 2B:
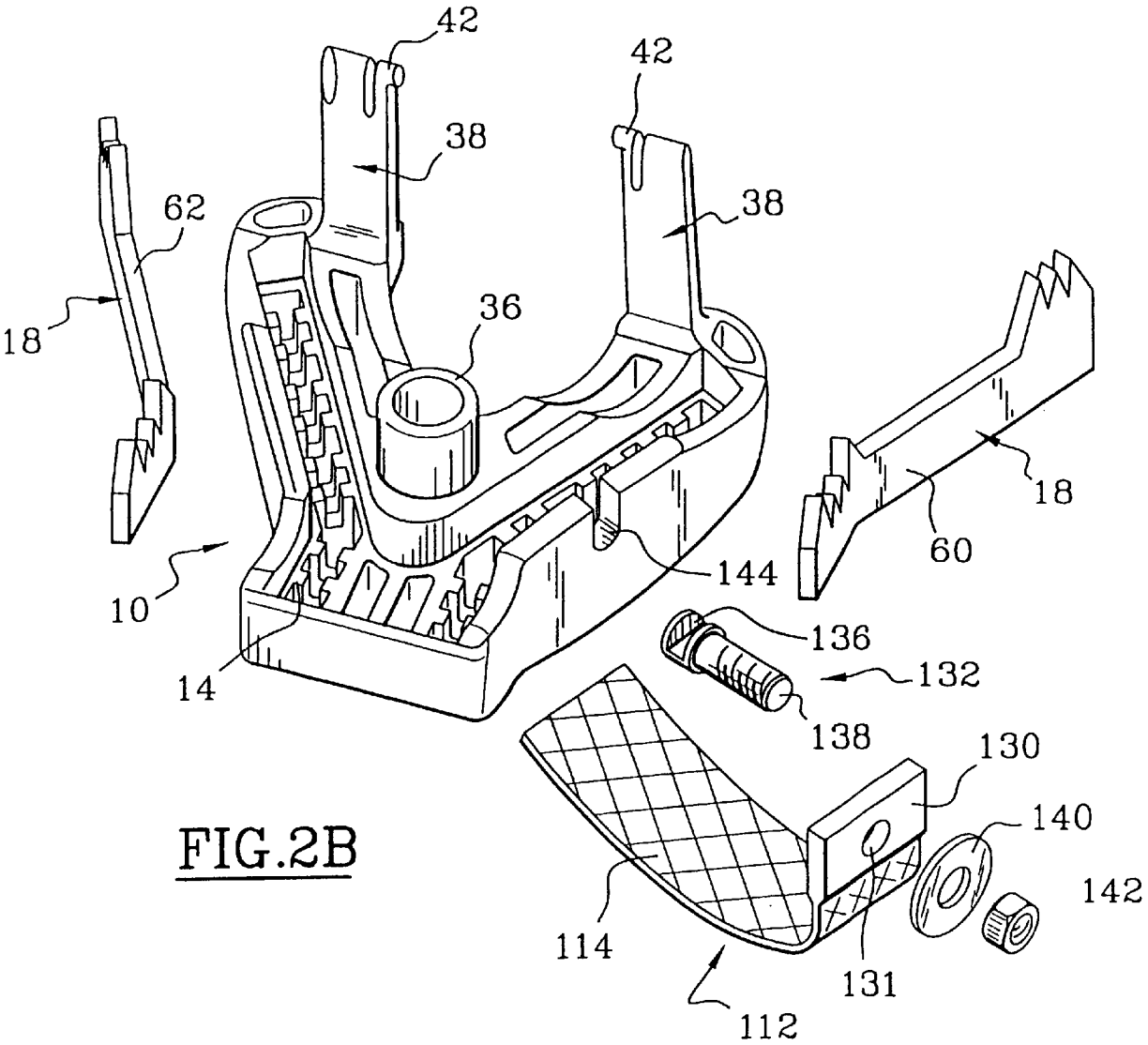

In accordance with a second embodiment, as shown in FIGS. 2A and 2B, there is provided a screw 132 whose axis is oriented transverse to the blades 18, i.e. perpendicular to the Z axis. The screw has a head 134 with a transverse slot 136, whose width is adapted to that of the blade 18 wherewith it is to contact. The threaded end 138 of the screw has such a length as to place the screw outside the lower body when the head is nested under the blade. A washer 140 and a nut 142 are provided for mounting on the screw. A recess 144 is formed in the stem 32 for accommodating the shank of the screw.

Like in the previous assembly, the braid 114 is placed by its terminal 130 upon the screw, under the washer 140.

Figure 3C:
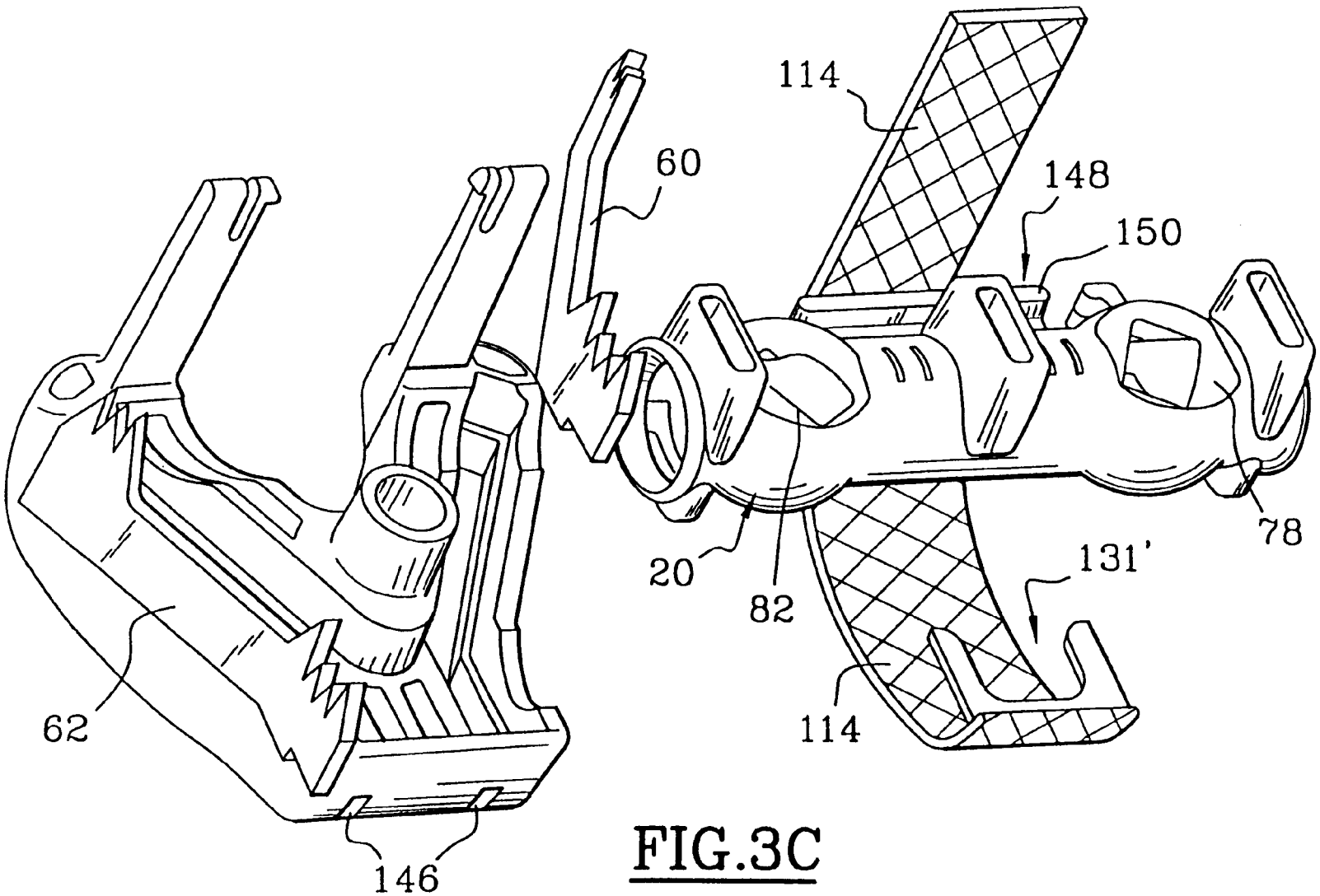

The third embodiment is shown in FIGS. 3A, 3*b* and 3C.

This embodiment is the preferred embodiment of the invention. The braid 114 comprises a crimped terminal 130', having an open eye 131', and this creates two tongues.

The lower body 10 has two through holes 146, formed on the external side of each of the blades 60 and 62.

Therefore, upon assembly, the two tongues of the eye 131' are inserted in the holes and slip under the blades 60 and 62 before the lower and upper bodies 10 and 12 are clamped against each other. When the clamping means 28 are operated, the blades are pressed against the tongues of the eye 131'.

In order that a better arrangement is achieved, a guide 148 is provided for the braid, in the form of a loop 150, integral with the lower body 10.

This variant is advantageous in that it needs no tool for installation and in that it ensures connection with the two blades on the same braid 114.

According to a simplified variant, the terminal can only have a single tongue, in contact with a single blade, and in this case the lower body only has one hole 146.

What is claimed is:

1. An electrical connector for the assembly of at least one branch neutral cable into a main neutral cable having a lower body and an upper body, both bodies having contact blades, means for accommodating these cables between the two bodies, and clamping means, wherein the connector comprises grounding means in contact with at least one of the blades, the grounding means being in contact with at least one of the blades due to the clamping action of the clamping means, the grounding means including a screw whose shank is oriented along the z-axis and includes a slot and a threaded end designed to allow a passage through a hole formed in the lower body adapted to accommodate the end of a braid and a nut.

2. An electrical connector for the assembly of at least one branch neutral cable into a main neutral cable having a lower body and an upper body, both bodies having contact blades, means for accommodating these cables between the two bodies, and clamping means, wherein the connector comprises grounding means in contact with at least one of the blades, the grounding means being in contact with at least one of the blades due to the clamping action of the clamping means, the grounding means including at least one hole formed in the lower body and having an opening on the external side of at least one of the blades, the hole being provided to accommodate the end of a braid.

3. An electric connector as claimed in claim 2, wherein when two of said holes are provided a terminal is open to form two tongues accommodated under each of said blades.

4. An electrical connector for the assembly of at least one branch neutral cable into a main neutral cable having a lower body and an upper body, both bodies having contact blades, means for accommodating these cables between the two bodies, and clamping means, wherein the connector comprises grounding means in contact with at least one of the blades, the grounding means being in contact with at least one of the blades due to the clamping action of the clamping means, the grounding means including a screw whose axis is oriented perpendicular to the z-axis of the blades whose head has a transverse slot, the screw having a threaded end and a nut to accommodate the end of a braid.

5. An electric connector as claimed in claim 4, wherein said lower body comprises a recess formed to accommodate said screw shank.

6. An electric connector as claimed in claim 4, wherein said braid comprises a crimped terminal having an eye for the passage of said screw shank.

7. An electric connector as claimed in claim 6, wherein said braid comprises a terminal with an eye matching the profile of a hole.

* * * * *